United States Patent [19]

Inoue et al.

[11] Patent Number: 4,698,105

[45] Date of Patent: Oct. 6, 1987

[54] WATER-IN-OIL TYPE EMULSION EXPLOSIVES

[75] Inventors: Atsuo Inoue, Asa; Kazuhiro Miyamoto, Onoda; Nobuo Hisada, Moriyama; Nobuyuki Okinaga, Kyoto, all of Japan

[73] Assignee: Nippon Kayaku Kabushiki Kaisha, Tokyo, Japan

[21] Appl. No.: 946,789

[22] Filed: Dec. 29, 1986

[30] Foreign Application Priority Data

Jan. 14, 1986 [JP] Japan ..... 61-4250

[51] Int. Cl.[4] ..... C06B 45/00

[52] U.S. Cl. ..... 149/2; 149/21; 149/46; 149/60; 149/61; 149/83; 149/85

[58] Field of Search ..... 149/2, 21, 46, 60, 61, 149/83, 85

[56] References Cited

U.S. PATENT DOCUMENTS

| | | | |
|---|---|---|---|
| 4,111,727 | 9/1978 | Clay | 149/2 |
| 4,287,010 | 9/1981 | Owen | 149/2 |
| 4,394,199 | 7/1983 | Barnhard et al. | 149/2 |
| 4,420,349 | 12/1983 | Bampfield | 149/2 |
| 4,555,278 | 11/1985 | Cescon et al. | 149/2 |

*Primary Examiner*—Stephen J. Lechert, Jr.
*Attorney, Agent, or Firm*—Nixon & Vanderhye

[57] ABSTRACT

Disclosed herein are water-in-oil type emulsion explosives comprising an aqueous solution of oxidizing agent, an oily material, hollow microspheres and an emulsifier containing from 0.1 to 10% by weight of fatty acid, from 0.1 to 10% by weight of fatty acid soap and from 80 to 99.8% by weight of a fatty acid ester mixture comprising from 0 to 3% by weight of sorbide fatty acid ester, from 5 to 50% by weight of sorbitan fatty acid ester and from 50 to 95% by weight of sorbitol fatty acid ester.

6 Claims, No Drawings

WATER-IN-OIL TYPE EMULSION EXPLOSIVES

BACKGROUND OF THE INVENTION

The present invention relates to water-in-oil type (hereinafter simply referred to as W/O type) emulsion explosives utilized for industrial blasting operations such as in excavating tunnels, quarrying and mining.

Since the first disclosure by U.S. Pat. No. 3,161,551, various modified inventions have been achieved for the W/O type emulsion explosives such as in U.S. Pat. Nos. 3,242,019, 3,447,978, 3,715,247, 3,770,522, 4,008,108 and 4,482,403, and G.B. Patent No. 1,593,163. The W/O type emulsion explosives in these inventions basically comprise as the continuous phase (oil component), mineral oils, waxes, other hydrophobic carbonaceous fuels, as the discontinuous phase an aqueous solution of oxidizing agent mainly composed of ammonium nitrate and W/O type emulsifier. By further adding optionally sensitizing agents such as nitric acid, strontium ions or hollow microspheres thereto, sensitivity widely ranging from booster initiation to No. 6 cap initiation can be obtained. It has been well known that these W/O type emulsion explosives exhibit high detonating velocity which can not be attained in conventional slurry explosives and are extremely safe as compared with dynamites.

Various improvements have been made for solving the inherent problem of low stability of the W/O type emulsion explosives caused by the nature that an emulsion is prepared by uniformly mixing two or more immiscible liquids with the aid of an emulsifier as shown in Japanese Patent Application Laying Open (KOKAI) No. 56-129694 (1981), U.S. Pat. No. 4,548,660 and U.S. Pat. No. 4,482,403 and, accordingly, the W/O type emulsion explosives have now become to be used widely at present. Since the W/O type emulsion explosives are plastic in their nature, they have advantage not attainable in the conventional slurry explosives that packaging into paper cartridge can be applied with ease and the use of W/O type emulsion explosives is fairly increased at present. However, the W/O type emulsion explosives are softer as compared with dynamite which have been also used as paper cartridges. Accordingly, it has been strongly pointed out in the actual field of using explosives that the W/O type emulsion explosives are readily deformable upon transportation and handling of paper cartridges and deformed paper cartridges of the W/O type emulsion explosive can not easily be charged into charging holes and thus are not convenient for use. In order to improve the strength of the paper cartridge, although the thickness of the cartridge paper may be increased as the countermeasure, this brings about other problems such as increase in the packaging cost or degradation in the blasting fume after the completion of blasting. Although there may be a method of adding powdery additives to increase the hardness of the W/O type emulsion explosives, this method brings about problems such as degradation in the stability of the W/O type emulsion explosives and induces remarkable reduction in the blasting characteristics.

Accordingly, how to increase the hardness of the W/O type emulsion explosives without degrading the stability thereof has been a significant problem to be solved in the art of the W/O type emulsion explosives.

U.S. Pat. No. 4,482,403 discloses an improvement for the pressure resistance of W/O type emulsion explosives by using an emulsifier in which the ratio of sorbide fatty acid ester, sorbitan fatty acid ester and sorbitol fatty acid ester is within a specified range (5–30:5–75:-15–90). However, it can not be said that the hardness of the W/O type emulsion explosives using the emulsifier having the above specified mixing ratio of esters in U.S. Pat. No. 4,482,403 is satisfactory.

As a result of the present inventors' studies and experiments for increasing the hardness of W/O type emulsion explosives without degrading the stability thereof, it has been found by the present inventors that the hardness of W/O type emulsion explosives can be significantly increased without degrading the stability thereof by using an emulsifier having an ester mixing ratio not known in the prior art, i.e., by using the ester mixture comprising from 0 to 3% by weight of sorbide fatty acid ester, from 5 to 50% by weight of sorbitan fatty acid ester and from 50 to 95% by weight of sorbitol fatty acid ester, and the present inventors have accomplished the present invention based on the findings.

DETAILED DESCRIPTION OF THE INVENTION

The present invention relates to water-in-oil type emulsion explosives comprising an aqueous solution of oxidizing agent, an oily material, hollow microspheres and an emulsifier containing from 0.1 to 10% by weight of fatty acid, from 0.1 to 10% by weight of fatty acid soap and from 80 to 99.8% by weight of a fatty acid ester mixture comprising of from 0 to 3% by weight of sorbite fatty acid ester, from 5 to 50% by weight of sorbitan fatty acid ester and from 50 to 95% by weight of sorbitol fatty acid ester.

The esters in the emulsifier according to the present invention comprising sorbide fatty acid ester, sorbitan fatty acid ester, sorbitol fatty acid ester, fatty acid and fatty acid soap are esters of sorbide, sorbitan and sorbitol with a fatty acid represented by the general formula:

R—COOH wherein R represents $C_nH_{2n+1}$, $C_nH_{2n-1}$, $C_nH_{2n-3}$, $C_nH_{2n-5}$ or $C_nH_{2n}O$ and n represents an integer of from 9 to 24, and the content of the fatty acid ester mixture in the emulsifier is from 80 to 99.8% and, preferably, from 85 to 98 % by weight.

The fatty acid usable in the present invention can include linear or branched saturated fatty acids such as lauric acid, myristic acid, palmitic acid, stearic acid, arachic acid, behenic acid and isostearic acid, mono-en unsaturated fatty acids such as oleic acid, elaidic acid, erucic acid and brassidic acid, poly-en unsaturated fatty acids such as linoleic acid, eleostearic acid, linolenic acid and arachidonic acid, or oxygen-containing fatty acids such as ricinoleic acid as well as mixtures thereof.

The stability of the W/O emulsion explosives is particularly excellent when using an emulsifier comprising an ester mixture of mono-en unsaturated fatty acid esters, mono-en unsaturated fatty acid soap and mono-en unsaturated fatty acid, particularly, comprising an ester mixture of oleic acid esters, oleic acid soap and oleic acid.

In the case of using two or more of fatty acids (including fatty acid forming esters or fatty acid soaps), oleic acid is preferably used by more than 60% by weight. The acid value of the mixed fatty acids is preferably from 150 to 300 and the iodine value is preferably from 50 to 200.

The mixture of fatty acid esters for use in the emulsifier according to the present invention comprises from 0 to 3% by weight, preferably, from 0.1 to 3% by weight of sorbide fatty acid ester, from 5 to 50% by weight, preferably, from 7 to 45% by weight of sorbitan fatty acid ester and from 50 to 95% by weight, preferably, from 52 to 90% by weight of sorbitol fatty acid ester. Sorbide fatty acid ester, sorbitan fatty acid ester and sorbitol fatty acid ester used in the emulsifier according to the present invention are monoester, diester, triester or tetraester, which may be used alone but usually used as a mixture of monoester, diester, triester and tetraester.

The mixing ratio of monoester, diester, triester and tetraester in the mixture of the sorbide fatty acid ester, sorbitan fatty acid ester and sorbitol fatty acid ester is preferably within a ratio of 0–50 : 0–50 : 0–50 : 0–20 and, more preferably, 5–45 : 5–45 : 5–45 : 5–18 by weight ratio.

The fatty acid in the emulsifier according to the present invention comprising sorbide fatty acid ester, sorbitan fatty acid ester, sorbitol fatty acid ester, fatty acid and fatty acid soap, is the same fatty acid as described above and contained in the emulsifier by from 0.1 to 10% and, preferably, from 0.5 to 8.0% by weight. If the content of the fatty acid is less than 0.1%, the stability of the W/O type emulsion explosives is poor, whereas the hardness of the W/O type emulsion explosive is reduced if over 10%.

The fatty acid soap in the emulsifier according to the present invention comprising sorbide fatty acid ester, sorbitan fatty acid ester, sorbitol fatty acid ester, fatty acid and fatty acid soap is the salt of the fatty acid as described above with alkali metal, alkaline earth metal, ammonia or an organic amine, sodium or potassium salt being particularly preferred. The content of the fatty acid soap in the emulsifier is from 0.1 to 10%, preferably, from 0.5 to 8.0% by weight. If the content of the fatty acid soap is out of the above-specified range, the stability of the W/O type emulsion explosives is reduced.

The emulsifier according to the present invention comprising sorbide fatty acid ester, sorbitan fatty acid ester, sorbitol fatty acid ester, fatty acid and fatty acid soap may also include, as other ingredient, sorbide, sorbitan and sorbitol as impurities. However, if the impurities are contained in a great amount in the emulsifier (for example, by more than 10% by weight), undesired effect on the production process of the W/O type emulsion explosives are caused.

The emulsifier according to the present invention comprising sorbide fatty acid ester, sorbitan fatty acid ester, sorbitol fatty acid ester, fatty acid and fatty acid soap may be used within a range from 0.5 to 7% by weight and, preferably, from 2.5 to 7% by weight based on the total amount of the W/O type emulsion explosives.

The emulsifier according to the present invention comprising sorbide fatty acid ester, sorbitan fatty acid ester, sorbitol fatty acid ester, fatty acid and fatty acid soap may be obtained, for example, by (1) a method of blending sorbide fatty acid ester, sorbitan fatty acid ester, sorbitol fatty acid ester, fatty acid and fatty acid soap or (2) a method of mixing sorbitol with fatty acid, esterifying the sorbitol under the presence of known catalyst such as sodium hydroxide, potassium hydroxide or sodium carbonate, adding sorbide fatty acid ester, sorbitan fatty acid ester and further adding sorbitol fatty acid ester, fatty acid and fatty acid soap as required.

The oxidizing agent used in the present invention includes ammonium nitrate, alkali metal nitrates, alkaline earth metal nitrates, alkali metal chlorates, alkaline earth metal chlorates, alkali metal perchlorates, alkaline earth metal perchlorates and ammonium perchlorate and used alone or in admixture in water.

It is also possible to use water-soluble amine nitrate such as monomethylamine nitrate, monoethylamine nitrate, hydrazine nitrate, dimethylamine nitrate, ethylenediamine dinitrate; water-soluble alkanol amine nitrate such as methanolamine nitrate or ethanolamine nitrate and water-soluble ethylene glycol mononitrate as an auxiliary sensitizer to the aqueous solution of oxidizing agent used in the present invention.

The water content in the aqueous solution of the oxidizing agent is preferably adjusted to such a content that the crystallization temperature of the aqueous solution of oxidizing agent is from 30° to 90° C. and, usually, the content is preferably from 5 to 40% by weight and, more preferably, from 7 to 30% by weight based on the total amount of the aqueous solution of oxidizing agent.

It is possible to use, as an auxiliary solvent, water-soluble organic solvents such as methanol, ethanol, formamide, ethylene glycol and glycerine in the aqueous solution of the oxidizing agent for lowering the crystallization temperature.

In this invention, the aqueous solution of the oxidizing agent may be used within a range from 50 to 95% by weight, preferably, from 60 to 94 % by weight based on the total amount of the W/O type emulsion explosives.

The oily material used in the present invention can include petroleum oils such as light oils, kerosene, mineral oils, lubricating oils and heavy oils, petroleum waxes such as paraffin wax and microcrystalline wax, hydrophobic vegetable or animal oils hydrophobic vegetable or animal waxes, and resins such as α-olefin polymer, pentadiene polymer, alicyclic hydrocarbon resin, epoxy resin, unsaturated polyester resin, polybutene, polyisobutylene, petroleum resin, butadiene resin, ethylene-vinyl acetate copolymer and polyethylene resin, and these oily materials may be used solely or as a mixture of two or more of them.

The single use or combined use of waxes such as paraffin wax and microcrystalline wax or resins which are solid at normal temperature or the use of mixture of the oily material as described above, which are solid at normal temperature, is more preferred since the hardness of the W/O type emulsion explosives is improved more.

The oily material may be used within a range from 1 to 10% by weight and preferably from 2 to 8% by weight based on the total amount of the W/O type emulsion explosives.

The W/O type emulsion explosives according to the present invention can show a wide range of initiating sensitivity from cap initiation to Booster initiation by the addition of appropriate hollow microspheres. As the hollow microspheres, hollow glass microspheres, hollow resin microspheres, silastic baloon, pearlite, usually employed in the W/O type emulsion explosives, may be used alone or as admixture of two or more of them.

The hollow microspheres used in the W/O type emulsion explosives according to the present invention are used within such an amount that the density of the resulted W/O type emulsion explosives may be set to less than 1.40 g/cc, preferably, less than 1.30 g/cc. The amount of the hollow microspheres used, although depending on the specific gravity, usually lies within a range from 0.5 to 20% by weight to the total amount of W/O type emulsion explosives.

In the W/O type emulsion explosives according to the present invention, it is possible to use explosive substances such as TNT and penthrite together with the hollow microspheres. Further, the function of the hollow microspheres can be partially substituted by generating suitable gas bubbles in the W/O type emulsion explosives by the use of chemical foaming agent or mechanical stirring.

In the W/O type emulsion explosives according to the present invention, it is also possible to add metal powder such as pulverized aluminum, pulverized magnesium, etc. and organic powder such as wood powder, starch, etc.

In the W/O type emulsion explosives according to the present invention, methane gas ignition property can be reduced by adding a reducer such as sodium chloride, potassium chloride, calcium chloride, etc. in the aqueous solution of the oxidizing agent or in the W/O type emulsion explosives in the form of powder.

The W/O type emulsion explosives according to the present invention comprising an aqueous solution of oxidizing agent, an oily material, hollow microspheres and an emulsifier containing fatty acid, fatty acid soap and fatty acid ester mixture comprising from 0 to 3% by weight of sorbide fatty acid ester, from 5 to 50% by weight of sorbitan fatty acid ester and from 50 to 95% by weight of sorbitol fatty acid ester can provide remarkable improvement in the hardness thereof and are much more excellent in the storage stability as compared with conventional W/O type emulsion explosives comprising similar aqueous solution of oxidizing agent, and hollow microspheres but containing different emulsifier.

This invention will now be explained more in detail while referring to the following non-limitative examples.

EXAMPLE 1

W/O type emulsion was prepared by melting 0.5 part by weight of liquid paraffin, 2.0 parts by weight of microcrystalline wax (manufactured by Esso Petroleum Co., trade name: Eslux 172), and 1.0 part by weight of paraffin wax (manufactured by Nippon Petroleum Co., trade name : 145° paraffin) at about 90° C., by admixing under stirring an aqueous solution of oxidizing agent comprising 69.8 parts by weight of ammonium nitrate, 10.0 parts by weight of calcium nitrate, and 12.0 parts by weight of water previously heated to dissolve at about 90° C. and 2.7 parts by weight of a mixture comprising sorbide stearic acid ester, sorbitan stearic acid ester, sorbitol stearic acid ester, stearic acid and sodium stearate as the emulsifier in which the mixing ratio is 2.3/39.7/52.0/2.5/3.5 by weight, the ratio of sorbide stearic acid ester/sorbitan stearic acid ester/ sorbitol stearic acid ester is 2.4/42.2/55.4 by weight, and the ratio of monoester/diester/triester is 1.5/1.0/0.5 by weight. W/O type emulsion explosive was prepared by admixing 2.5 parts by weight of glass bubbles (manufactured by 3M Co., trade name: B15/250) into the thus obtained emulsion.

COMPARATIVE EXAMPLE 1

W/O type emulsion explosive was prepared in the same manner (ingredients, ratio and method) as in Example 1 except for using an emulsifier comprising sorbide stearic acid ester, sorbitan stearic acid ester, sorbitol stearic acid ester, stearic acid and sodium stearate, in which the mixing ratio is 25.0/57.5/11.5/2.5/3.5 by weight, the ratio of sorbide stearic acid ester/sorbitan stearic acid ester/ sorbitol stearic acid ester is 26.6/61.2/12.2 by weight and the ratio of monoester/diester/triester is 1.5/1.0/0.5 by weight.

EXAMPLE 2

W/O type emulsion was prepared by melting 4.0 parts by weight of microcrystalline wax (Eslux 172) at about 90° C, and admixing under stirring an aqueous solution of oxidizing agent comprising 11.5 parts by weight of water, 69.3 parts by weight of ammonium nitrate and 10.0 parts by weight of sodium nitrate previously heated to dissolve at about 90° C. and 2.7 parts by weight of a mixture comprising sorbide linoleic acid ester, sorbitan linoleic acid ester, sorbitol linoleic acid ester, linoleic acid and potassium linoleate as an emulsifier, in which the mixing ratio is 2.5/10.0/81.2/3.5/2.8 by weight, the ratio of sorbide linoleic acid ester/sorbitan linoleic acid ester/sorbitol linoleic acid ester is 2.7/10.7/86.6 by weight, and the ratio of monoester/diester/triester is 1.0/1.5/0.5 by weight. Then, 2.5 parts by weight of glass bubbles (B15/250) were added thereinto and mixed to obtain W/O type emulsion explosive.

COMPARATIVE EXAMPLE 2

W/O type emulsion explosive was prepared in the same manner (ingredients, ratio and method) as in Example 2 except for using an emulsifier comprising sorbide linoleic acid ester, sorbitan linoleic acid ester, sorbitol linoleic acid ester, linoleic acid and potassium linoleate, in which the mixing ratio is 15.0/61.5/17.2/3.5/2.8 by weight, the ratio of sorbide linoleic acid ester/sorbitan linoleic acid ester/sorbitol linoleic acid ester is 16.0/65.6/18.4 by weight, and the ratio of monoester/diester/triester is 1.0/1.5/0.5 by weight.

EXAMPLE 3

W/O type emulsion was prepared by heating and mixing 2.5 parts by weight of microcrystalline wax (Eslux 172) and 0.5 parts by weight of $\alpha$-olefin polymer with molecular weight of about 700 (manufactured by Lion Yushi Co., trade name: Lipoloob 70) at 90° C., admixing under stirring an aqueous solution of oxidizing agent comprising 10.5 parts by weight of water, 63.5 parts by weight of ammonium nitrate, 10.0 parts by weight of sodium nitrate and 5.0 parts by weight of sodium perchlorate previously heated to dissolve at about 90° C., as well as 2.0 parts by weight of a mixture comprising sorbide oleic acid ester, sorbitan oleic acid ester, sorbitol oleic acid ester, oleic acid and sodium oleate as an emulsifier, in which the mixing ratio is 2.0/21.0/71.0/3.5/2.5 by weight, the ratio of sorbide oleic acid ester, sorbitan oleic acid ester, sorbitol oleic acid ester is 2.1/22.3/75.6 by weight, and the ratio of monoester/ diester/triester is 1.0/1.5/0.5 by weight. Then, 6.0 parts by weight of glass bubbles (manufactured by 3M Co., trade name: B28/750) were admixed to obtain W/O type emulsion explosive.

COMPARATIVE EXAMPLE 3

W/O type emulsion explosive was prepared in the same manner (ingredients, ratio and method) as in Example 3 except for using an emulsifier comprising sorbide oleic acid ester, sorbitan oleic acid ester, sorbitol oleic acid ester, oleic acid and sodium oleate, in which the mixing ratio is 25.0/51.5/17.5/3.5/2.5 by weight, the ratio of sorbide oleic acid ester/sorbitan oleic acid ester/sorbitol oleic acid ester is 26.6/54.8/18.6 by weight and the ratio of monoester/diester/triester is 1.0/1.5/0.5 by weight.

EXAMPLE 4

W/O type emulsion was prepared by heating and mixing 0.5 parts by weight of α-olefin polymer (Lipoloob 70) and 2.5 parts by weight of microcrystalline wax (Eslux 172) at about 90° C. and further mixing thereto under stirring an aqueous solution of oxidizing agent comprising 10.5 parts by weight of water, 62.5 parts by weight of ammonium nitrate, 10.0 parts by weight of sodium nitrate and 5.0 parts by weight of sodium perchlorate previously heated to dissolve at 90° C., as well as 3.0 parts by weight of a mixture defined in this invention as an emulsifier comprising sorbide oleic acid ester, sorbitan oleic acid ester, sorbitol oleic acid ester, oleic acid and sodium oleate in which the mixing ratio is 0.5/22.5/71.5/3.0/2.5 by weight, the ratio of sorbide oleic acid ester/sorbitan oleic acid ester/sorbitol oleic acid ester is 0.5/23.8/75.7 by weight and the ratio of monoester/diester/triester is 1.0/1.5/0.5 by weight. Then, 6.0 parts by weight of glass bubbles (B28/750) were admixed to obtain W/O type emulsion explosive.

COMPARATIVE EXAMPLE 4

W/O type emulsion explosive was prepared in the same manner (ingredients, ratio and method) as in Example 4 except for using an emulsifier comprising sorbide oleic acid ester, sorbitan oleic acid ester, sorbitol oleic acid ester, oleic acid and sodium oleate, in which the mixing ratio is 5.5/65.0/23.5/3.5/2.5 by weight, the ratio of sorbide oleic acid ester/sorbitan oleic acid ester/sorbitol oleic acid ester is 5.9/69.1/25.0 by weight and the ratio of monoester/ diester/triester is 1.0/1.5/0.5 by weight.

EXAMPLE 5

W/O type emulsion was prepared by heating and mixing 3.0 parts by weight of microcrystalline wax (Eslux 172) and 1.0 part by weight of paraffin wax (145° paraffin) at about 90° C. and further mixing thereto under stirring an aqueous solution of oxidizing agent comprising 12.0 parts by weight of water, 70.3 parts by weight of ammonium nitrate, and 5.0 parts by weight of sodium nitrate previously heated to dissolve at 90° C. and 1.7 parts by weight of a mixture comprising sorbide oleic acid ester, sorbitan oleic acid ester, sorbitol oleic acid ester, oleic acid and sodium oleate in which the mixing ratio is 0.5/22.5/71.5/3.0/2.5 by weight, the ratio of sorbide oleic acid ester/sorbitan oleic acid ester/sorbitol oleic acid ester is 0.5/23.8/75.7 by weight and the ratio of monoester/diester/triester is 1.0/1.5/0.5 by weight, as well as 1.0 part by weight of a mixture comprising sorbide stearic acid ester, sortiban stearic acid ester, sorbitol stearic acid ester, stearic acid and sodium stearate, in which the mixing ratio is 2.3/39.7/52.0/2.5/3.5 by weight, the ratio of sorbide stearic acid ester/sorbitan stearic acid ester/sorbitol stearic acid ester is 2.4/42.2/55.4 and the ratio of monoester/diester/triester is 1.5/1.0/0.5 by weight. Then, 6.0 parts by weight of glass bubbles (B28/750) were admixed to obtain W/O type emulsion explosive.

COMPARATIVE EXAMPLE 5

W/O type emulsion explosive was prepared in the same manner (ingredients, ratio and method) as in Example 5 except for using, as an emulsifier, 1.7 parts by weight of a mixture comprising sorbide oleic acid ester, sorbitan oleic acid ester, sorbitol oleic acid ester, oleic acid and sodium oleate, in which the mixing ratio is 5.5/65.0/23.5/3.5/2.5 by weight, the ratio of sorbide oleic acid ester/sorbitan oleic acid ester/sorbitol oleic acid ester is 5.9/69.1/25.0 and the ratio of monoester/-diester/triester is 1.0/1.5/0.5 and 1.0 part by weight of a mixture comprising sorbide stearic acid ester, sorbitan stearic acid ester, sorbitol stearic acid ester, stearic acid and sodium stearate, in which the mixing ratio is 25.0/57.5/11.5/2.5/3.5 by weight, the ratio of sorbide stearic acid ester/sorbitan stearic acid ester/sorbitol stearic acid ester is 26.6/61.2/12.2 by weight and the ratio of monoester/diester/triester is 1.5/1.0/0.5 by weight.

COMPARATIVE EXAMPLE 6

W/O type emulsion explosive was prepared in the same manner (ingredients, ratio and method) as in Example 4 except for using, as an emulsifier, a mixture comprising sorbide oleic acid ester, sorbitan oleic acid ester, sorbitol oleic acid ester, oleic acid and sodium oleate, in which the mixing ratio is 0.5/18.5/57.5/12.0/11.5 by weight, the ratio of sorbide oleic acid ester/sorbitan oleic acid ester/ sorbitol oleic acid ester is 0.6/24.2/75.2 by weight and the ratio of monoester/diester/triester is 1.0/1.5/0.5 by weight.

COMPARATIVE EXAMPLE 7

W/O type emulsion explosive was prepared in the same manner (ingredients, ratio and method) as in Example 4 except for using, as an emulsifier, a mixture comprising sorbide oleic acid ester, sorbitan oleic acid ester, sorbitol oleic acid ester, oleic acid and sodium oleate, in which the mixing ratio is 0.7/25.0/74.2/0.05/0.05 by weight, the ratio of sorbide oleic acid ester/sorbitan oleic acid ester/ sorbitol oleic acid ester is 0.7/25.0/74.3 by weight and the ratio of monoester/diester/triester is 1.0/1.5/0.5 by weight.

The compositions in Examples 1–5 and Comparative Examples 1–7 are shown collectively in Table 1.

TABLE 1

| | Example | | | | | Comparative Example | | | | | | |
|---|---|---|---|---|---|---|---|---|---|---|---|---|
| | 1 | 2 | 3 | 4 | 5 | 1 | 2 | 3 | 4 | 5 | 6 | 7 |
| Liquid paraffin | 0.5 | — | — | — | — | 0.5 | — | — | — | — | — | — |
| Eslax 172 | 2.0 | 4.0 | 2.5 | 2.5 | 3.0 | 2.0 | 4.0 | 2.5 | 2.5 | 3.0 | 2.5 | 2.5 |
| 145° paraffin | 0.5 | — | — | — | 1.0 | 0.5 | — | — | — | 1.0 | — | — |
| α-olefin polymer | — | — | 0.5 | 0.5 | — | — | — | 0.5 | 0.5 | — | 0.5 | 0.5 |
| Water | 12.0 | 11.5 | 10.5 | 10.5 | 12.0 | 12.0 | 11.5 | 10.5 | 10.5 | 12.0 | 10.5 | 10.5 |
| Ammonium nitrate | 69.8 | 69.3 | 63.5 | 62.5 | 70.3 | 69.8 | 69.3 | 63.5 | 62.5 | 70.3 | 62.5 | 62.5 |
| Sodium nitrate | — | 10.0 | 10.0 | 10.0 | 5.0 | — | 10.0 | 10.0 | 10.0 | 5.0 | 10.0 | 10.0 |
| Calcium nitrate | 10.0 | — | — | — | — | 10.0 | — | — | — | — | — | — |
| Sodium perchlorate | — | — | 5.0 | 5.0 | — | — | — | 5.0 | 5.0 | — | 5.0 | 5.0 |

TABLE 1-continued

| | | Example | | | | | Comparative Example | | | | | | |
|---|---|---|---|---|---|---|---|---|---|---|---|---|---|
| | | 1 | 2 | 3 | 4 | 5 | 1 | 2 | 3 | 4 | 5 | 6 | 7 |
| Glass bubbles B15/250 | | 2.5 | 2.5 | — | — | — | 2.5 | 2.5 | — | — | — | — | — |
| Glass bubbles B28/750 | | — | — | 6.0 | 6.0 | 6.0 | — | — | 6.0 | 6.0 | 6.0 | 6.0 | 6.0 |
| Emulsifier | 1* | 2.7 | — | — | — | 1.0 | — | — | — | — | — | — | — |
| | 2* | — | — | — | — | — | 2.7 | — | — | — | 1.0 | — | — |
| | 3* | — | 2.7 | — | — | — | — | — | — | — | — | — | — |
| | 4* | — | — | — | — | — | — | 2.7 | — | — | — | — | — |
| | 5* | — | — | 2.0 | — | — | — | — | — | — | — | — | — |
| | 6* | — | — | — | — | — | — | — | 2.0 | — | — | — | — |
| | 7* | — | — | — | 3.0 | 1.7 | — | — | — | — | — | — | — |
| | 8* | — | — | — | — | — | — | — | — | 3.0 | 1.7 | — | — |
| | 9* | — | — | — | — | — | — | — | — | — | — | 3.0 | — |
| | 10* | — | — | — | — | — | — | — | — | — | — | — | 3.0 |

*1: Sorbide stearic acid ester/sorbitan stearic acid ester/sorbitol stearic acid ester/stearic acid/sodium stearate = 2.3/39.7/52.0/2.5/3.5 (sorbide stearic acid ester/sorbitan stearic acid ester/sorbitol stearic acid ester = 2.4/42.2/55.4) (monoester/diester/triester = 1.5/1.0/0.5).

*2: Sorbide stearic acid ester/sorbitan stearic acid ester/sorbitol stearic acid ester/stearic acid/sodium stearate = 25.0/57.5/11.5/2.5/3.5 (sorbide stearic acid ester/sorbitan stearic acid ester/sorbitol stearic acid ester = 26.6/61.2/12.2) (monoester/diester/triester = 1.5/1.0/0.5).

*3: Sorbide linoleic acid ester/sorbitan linoleic acid ester/sorbitol linoleic acid ester/linoleic acid/potassium linoleate = 2.5/10.0/81.2/3.5/2.8 (sorbide linoleic acid ester/sorbitan linoleic acid ester/sorbitol linoleic acid ester = 2.7/10.7/86.6) (monoester/diester/triester = 1.0/1.5/0.5).

*4: Sorbide linoleic acid ester/sorbitan linoleic acid ester/sorbitol linoleic acid ester/linoleic acid/potassium linoleate = 15.0/61.5/17.2/3.5/2.8 (sorbide linoleic acid ester/sorbitan linoleic acid ester/sorbitol linoleic acid ester 32 16.0/65.6/18.4) (monoester/diester/triester = 1.0/1.5/0.5).

*5: Sorbide oleic acid ester/sorbitan oleic acid ester/sorbitol oleic acid ester/oleic acid/sodium oleate = 2.0/21.0/71.0/3.5/2.5 (sorbide oleic acid ester/sorbitan oleic acid ester/sorbitol oleic acid ester = 2.1/22.3/75.6) (monoester/diester/triester = 1.0/1.5/0.5).

*6: Sorbide oleic acid ester/sorbitan oleic acid ester/sorbitol oleic acid ester/oleic acid/sodium oleate = 25.0/51.5/17.5/3.5/2.5 (sorbide oleic acid ester/sorbitan oleic acid ester/sorbitol oleic acid ester = 26.6/54.8/18.6) (monoester/diester/triester = 1.0/1.5/0.5).

*7: Sorbide oleic acid ester/sorbitan oleic acid ester/sorbitol oleic acid ester/oleic acid/sodium oleate = 0.5/22.5/71.5/3.0/2.5 (sorbide oleic acid ester/sorbitan oleic acid ester/sorbitol oleic acid ester = 0.5/23.8/75.7) (monoester/diester/triester = 1.0/1.5/0.5).

*8: Sorbide oleic acid ester/sorbitan oleic acid ester/sorbitol oleic acid ester/oleic acid/sodium oleate = 5.5/65.0/23.5/3.5/2.5 (sorbide oleic acid ester/sorbitan oleic acid ester/sorbitol oleic acid ester = 5.9/69.1/25.0) (monoester/diester/triester = 1.0/1.5/0.5).

*9: Sorbide oleic acid ester/sorbitan oleic acid ester/sorbitol oleic acid ester/oleic acid/sodium oleate = 0.5/18.5/57.5/12.0/11.5 (sorbide oleic acid ester/sorbitan oleic acid ester/sorbitol oleic acid ester = 0.6/24.2/75.2) (monoester/diester/triester = 1.0/1.5/0.5).

*10: Sorbide oleic acid ester/sorbitan oleic acid ester/sorbitol oleic acid ester/oleic acid/sodium oleate = 0.7/25.0/74.2/0.05/0.05 (sorbide oleic acid ester/sorbitan oleic acid ester/sorbitol oleic acid ester = 0.7/25.0/74.3) (monoester/diester/triester = 1.0/1.5/0.5).

For examining the hardness of the W/O type emulsion explosives in Examples 1–5 and Comparative Examples 1–7, penetration test often employed in dynamite was carried out.

Further, initiation sensitivity and air-gap sensitivity were measured for the W/O type emulsion explosives in Examples 1–5 and Comparative Examples 1–7.

According to the study of the present inventors, it has been found that, in the case of conducting a forced heating and cooling test of maintaining W/O type emulsion explosives at 60° C. for 24 hours and then at −20° C. for 24 hours as one temperature cycle, the one temperature cycle substantially corresponds to usual one month storage in a magazine. Accordingly, the forced heating and cooling test was used as a substitute for the storage test and the forced heating-cooling cycle was repeated until the number of cycles corresponding to 36 months storage were attained.

These results are collectively shown in Table 2.

TABLE 2

| | | Example | | | | | Comparative Example | | | | | | |
|---|---|---|---|---|---|---|---|---|---|---|---|---|---|
| | | 1 | 2 | 3 | 4 | 5 | 1 | 2 | 3 | 4 | 5 | 6 | 7 |
| Specific gravity | | 1.13 | 1.12 | 1.13 | 1.13 | 1.12 | 1.13 | 1.12 | 1.13 | 1.13 | 1.12 | 1.13 | 1.13 |
| Just | Penetration *1 | 16.0 | 9.2 | 8.8 | 9.0 | 9.1 | 22.0 | 11.8 | 12.3 | 12.5 | 12.6 | 15.2 | 9.1 |
| after | I.S. *2 | No. 6 | No. 6 | No. 6 | No. 6 | No. 6 | No. 6 | No. 6 | No. 6 | No. 6 | No. 6 | No. 6 | No. 6 |
| preparation | A.G.S. *3 | 2.5 | 2.5 | 2.5 | 2.5 | 2.5 | 2.5 | 2.5 | 2.5 | 2.5 | 2.5 | 2.5 | 2.5 |
| 6 months *4 | Penetration | 16.0 | 9.0 | 9.0 | 8.9 | 9.2 | 21.9 | 11.9 | 12.2 | 12.6 | 12.4 | 15.0 | 9.0 |
| after | I.S. | No. 6 | No. 6 | No. 6 | No. 6 | No. 6 | No. 6 | No. 6 | No. 6 | No. 6 | No. 6 | No. 6 | No. 6 |
| preparation | A.G.S. | 2.5 | 2.5 | 2.5 | 2.5 | 2.5 | 2.5 | 2.5 | 2.5 | 2.5 | 2.5 | 2.5 | 2.0 |
| 12 months | Penetration | 16.2 | 9.0 | 9.0 | 9.1 | 9.0 | 21.8 | 12.2 | 12.3 | 12.3 | 12.4 | 15.0 | 9.2 |
| after | I.S. | No. 6 | No. 6 | No. 6 | No. 6 | No. 6 | No. 6 | No. 6 | No. 6 | No. 6 | No. 6 | No. 6 | No. 6 |
| preparation | A.G.S. | 2.0 | 2.5 | 2.5 | 2.5 | 2.5 | 2.0 | 2.5 | 2.5 | 2.5 | 2.5 | 2.0 | 1.5 |
| 24 months | Penetration | 16.1 | 9.2 | 8.9 | 9.1 | 9.2 | 22.1 | 11.9 | 12.1 | 12.4 | 12.4 | 15.3 | 9.2 |
| after | I.S. | No. 6 | No. 6 | No. 6 | No. 6 | No. 6 | No. 6 | No. 6 | No. 6 | No. 6 | No. 6 | No. 6 | No. 6 |
| preparation | A.G.S. | 2.0 | 2.0 | 2.0 | 2.5 | 2.5 | 2.0 | 2.0 | 2.0 | 2.5 | 2.5 | 2.0 | 1.5 |
| 36 months | Penetration | 16.1 | 9.1 | 9.1 | 8.9 | 9.0 | 22.1 | 12.5 | 12.5 | 12.2 | 12.8 | 14.9 | 9.0 |
| after | I.S. | No. 6 | No. 6 | No. 6 | No. 6 | No. 6 | No. 6 | No. 6 | No. 6 | No. 6 | No. 6 | No. 6 | No. 6 |

TABLE 2-continued

| | Example | | | | | Comparative Example | | | | | | |
|---|---|---|---|---|---|---|---|---|---|---|---|---|
| | 1 | 2 | 3 | 4 | 5 | 1 | 2 | 3 | 4 | 5 | 6 | 7 |
| Specific gravity | 1.13 | 1.12 | 1.13 | 1.13 | 1.12 | 1.13 | 1.12 | 1.13 | 1.13 | 1.12 | 1.13 | 1.13 |
| preparation A.G.S. | 1.5 | 1.5 | 2.0 | 2.5 | 2.0 | 1.5 | 1.5 | 2.0 | 2.0 | 2.0 | 1.5 | 1.0 |

*1: Penetration is measured by dropping an iron needle of 64 g of weight with a tip angle of 45° from 36 mm height and represented by the depth of the needle intruded to the center of the explosives on mm unit.
*2: Initiation sensitivity No. 6 represents No. 6 cap.
*3: The air-gap sensitivity represents sympathetic detonation on sand with paper cylinder of 30 $\phi$ and indicated by the multiple number of diameter of explosive chemical.
*4: The number of month is obtained by converting the number of temperature cycle into the number of month while taking one temperature cycle, in which the W/O type emulsion explosive is maintained at 60° C. for 24 hours and then maintained at −20° C. for 24 hours, as one month.

Comparing Examples 1,2,3,4, and 5 with Comparative Examples 1,2,3, 4 and 5 correspondingly to each other, Examples 1–5 using the emulsifier according to the present invention show smaller penetration value by from 2.6 to 6 mm as compared with corresponding Comparative examples. In other words, the hardness of the explosive is increased, while the storage stability is substantially equal with that int he corresponding Examples and, thus, it is apparent that the W/O type emulsion explosive according to the present invention is much improved in the hardness without degrading the stability thereof.

In Example 1 and Comparative Example 1, comparison is made for the composition of relatively soft W/O type emulsion explosives, but also in this case, the explosive harder than the conventional explosives can be obtained by using the emulsifier according to the present invention.

By the way, it has been found by the study of the present inventors that the hardness of the W/O type emulsion explosive is preferably about less than 10 mm in penetration for handling the explosives in paper cartridge with no troubles and, in view of the above, the W/O type emulsion explosives of Examples 2–5 according to the present invention can be used with no practical problems.

Further, upon comparing Example 4 with Comparative Example 4, there are no problems both in the hardness and in the stability with respect to Example 4, whereas, in Comparative Example 4 using an emulsifier having the sorbide fatty acid ester content of 5.9% by weight in the ester mixture, the penetration is higher than that of Example 4 and, in addition, some reduction is recognized in the stability after 36 months.

Further, upon comparing Example 4 with Comparative Example 6, the penetration is increased and the storage stability is reduced in the case of Comparative Example 6 which is out of the scope of the present invention and, accordingly, the advantages of the present invention are apparent.

Furthermore, upon comparing Example 4 with Comparative Example 7, the storage stability is poor in the case of Comparative Example which is out of the scope of the present invention.

The difference in the storage stability between Example 3 and Example 4 is due to the amount of the emulsifier used, while the difference in the storage stability between Examples 4, 5 and Examples 1, 2 depend on whether or not mono-en unsaturated fatty acid ester, particularly, oleic acid ester is contained.

What is claimed is:

1. A water-in-oil type emulsion explosive comprising an aqueous solution of oxidizing agent, an oily material, hollow microspheres, an emulsifier containing from 0.1 to 10% by weight of fatty acid, from 0.1 to 10% by weight of fatty acid soap and from 80 to 99.8% by weight of a fatty acid ester mixture comprising from 0 to 3% by weight of sorbide fatty acid ester and from 5 to 50% by weight of sorbitan fatty acid ester and from 50 to 95% by weight of sorbitol fatty acid ester.

2. A water-in-oil type emulsion explosive according to claim 1, wherein the content of said aqueous solution of oxidizing agent is from 50 to 95% by weight, the content of said oily material is from 1 to 10% by weight, the content of said emulsifier is from 0.5 to 7% by weight and the content of said hollow microspheres is from 0.5 to 20% by weight.

3. A water-in-oil type emulsion explosive according to claim 1, wherein the mixing ratio of monoester/diester/ triester/tetraester in said fatty acid ester mixture comprising sorbide fatty acid ester, sorbitan fatty acid ester and sorbitol fatty acid ester is 5–45 : 5–45 : 5–45 : 5–18 by weight.

4. A water-in-oil type emulsion explosive according to claim 1, wherein waxes and/or resins which are solid at normal temperature are used as said oily material.

5. A water-in-oil type emulsion explosive according to claim 1, wherein said emulsifier comprises sorbide mono-en unsaturated fatty acid ester, sorbitan mono-en unsaturated fatty acid ester, sorbitol mono-en unsaturated fatty acid ester, mono-en unsaturated fatty acid and mono-en unsaturated fatty acid soap.

6. A water-in-oil type emulsion explosive according to claim 1, wherein said emulsifier comprises sorbide oleic acid ester, sorbitan oleic acid ester, sorbitol oleic acid ester, oleic acid and oleic acid soap.

* * * * *